US009478929B2

(12) United States Patent
Smith et al.

(10) Patent No.: US 9,478,929 B2
(45) Date of Patent: Oct. 25, 2016

(54) LIGHT BULB RECEPTACLES AND LIGHT BULB SOCKETS

(71) Applicant: Ken Smith, Kellogg, ID (US)

(72) Inventors: Ken Smith, Kellogg, ID (US); John U. Jansen, Kellogg, ID (US)

(73) Assignee: Ken Smith, Kellogg, ID (US)

( * ) Notice: Subject to any disclaimer, the term of this patent is extended or adjusted under 35 U.S.C. 154(b) by 47 days.

(21) Appl. No.: 14/464,625

(22) Filed: Aug. 20, 2014

(65) Prior Publication Data

US 2015/0369462 A1 Dec. 24, 2015

Related U.S. Application Data

(60) Provisional application No. 62/015,919, filed on Jun. 23, 2014.

(51) Int. Cl.
*H01R 33/00* (2006.01)
*H01R 33/22* (2006.01)

(52) U.S. Cl.
CPC ..... *H01R 33/22* (2013.01)

(58) Field of Classification Search
CPC .. H01R 13/62; H01R 13/6277; H01R 33/22; H01R 33/46; H01R 33/0836; H01R 33/0845
USPC ..... 362/652, 95, 640, 655
See application file for complete search history.

(56) References Cited

U.S. PATENT DOCUMENTS 656,284 A 8/1900 Froschl
1,104,577 A 7/1914 Thomas
1,187,301 A 6/1916 Goodridge
1,262,936 A 4/1918 Fowler
1,632,599 A 6/1927 Hayward
1,640,189 A 8/1927 Hamiel
1,702,135 A 2/1929 Sawers et al.
1,721,365 A 7/1929 Zwetsch
1,810,901 A 6/1931 Bormann et al.
1,818,380 A 8/1931 Cartier (Continued)

FOREIGN PATENT DOCUMENTS

JP 5-214354 6/2013
WO PCT/US2015/037253 9/2015

OTHER PUBLICATIONS

Cofini, U.S. Appl. No. 61/571,765, filed Jul. 5, 2011, titled "Threadless Light Bulb Socket", 50 pages.

*Primary Examiner* — Ali Alavi
(74) *Attorney, Agent, or Firm* — Wells St. John P.S.

(57) ABSTRACT

Light bulb receptacles and light bulb sockets are described. According to one aspect, a light bulb receptacle includes a housing which defines a housing chamber, a light bulb socket within the housing chamber and which comprises a first end and a second end about a light bulb chamber which is configured to receive a base of a light bulb, wherein the light bulb socket further comprises a plurality of fingers which extend outwardly from the first end toward the second end and define an opening to the light bulb chamber at the second end, wherein the fingers are individually configured to move outwardly from the light bulb chamber during insertion and removal of the light bulb via the opening to the light bulb chamber, and wherein the fingers individually comprise an engagement member configured to engage a base of the light bulb received within the light bulb chamber and to retain the light bulb received within the light bulb chamber.

20 Claims, 3 Drawing Sheets

(56) References Cited

U.S. PATENT DOCUMENTS 2,025,564 A 12/1935 Blake
2,056,502 A 10/1936 Borell
2,071,769 A 2/1937 Schlicker et al.
2,122,848 A 7/1938 Steams
2,191,366 A 2/1940 Carrol
2,209,808 A 7/1940 Bryant et al.
2,283,934 A 5/1942 Jorgensen
2,372,288 A 2/1945 Frank
2,494,755 A 1/1950 Grover
2,503,577 A 4/1950 McHenry et al.
2,511,037 A 6/1950 Bedoiseau
2,555,999 A 8/1951 Teglas et al.
2,606,280 A * 8/1952 Stroschein ..... F21V 1/00 362/357
2,638,088 A 4/1953 Perkins
2,882,039 A 6/1954 Tinnerman
2,738,474 A 3/1956 Stube
2,741,747 A 4/1956 Woofter
2,771,306 A 11/1956 Vitcha et al.
2,791,679 A 5/1957 Hierholzer, Jr. et al.
2,800,635 A 7/1957 Christenbery
3,046,672 A 7/1962 Lace
3,056,941 A 10/1962 Erikson
3,173,473 A 3/1965 Loveland
3,305,961 A * 2/1967 Lanzo ..... G09F 21/04 362/486
3,315,072 A * 4/1967 Harling ..... F21S 8/086 362/329
3,403,901 A 10/1968 Servadio
3,430,184 A 2/1969 Acord
3,452,316 A 6/1969 Panek et al.
3,465,284 A 9/1969 McManus
3,484,736 A 12/1969 Wyse
3,569,903 A 3/1971 Brishka
3,569,907 A 3/1971 Landgraf
3,573,705 A 4/1971 Magi
3,594,681 A 7/1971 Weiss
3,609,346 A * 9/1971 Lund ..... F21S 8/02 362/364
3,633,023 A 1/1972 Castiglioni
3,641,636 A * 2/1972 Foster ..... D04H 18/00 28/115
3,659,329 A 5/1972 Walker
3,676,835 A 7/1972 Holly
3,678,439 A 7/1972 Vetter
3,723,944 A 3/1973 Gauchat et al.
3,793,685 A 2/1974 Knecht
3,800,267 A 3/1974 Burgess et al.
3,805,211 A 4/1974 Moore
3,895,195 A 7/1975 Morrison et al.
3,915,536 A 10/1975 Glantz
3,936,122 A 2/1976 Hagelberg
4,008,941 A 2/1977 Smith
4,017,139 A 4/1977 Nelson
4,040,714 A 8/1977 Grover et al.
4,061,154 A * 12/1977 Cox ..... A45B 25/18 135/33.41
4,069,630 A * 1/1978 Chess ..... E06B 3/6715 428/34
4,099,820 A 7/1978 DeLano
4,100,448 A 7/1978 Chipner et al.
4,121,134 A 10/1978 Fontenelle
4,134,634 A 1/1979 Baur et al.
4,159,161 A 6/1979 Timmer
4,163,998 A * 8/1979 Anderson ..... F21V 1/00 362/249.16
4,208,082 A 6/1980 Davies et al.
4,210,373 A 7/1980 McGee
4,222,623 A 9/1980 Hultberg
4,279,458 A 7/1981 Knapp
4,319,796 A 3/1982 Wiley
4,333,131 A * 6/1982 Hujimoto ..... B60Q 1/0683 362/272
4,374,606 A 2/1983 Lathrop
4,376,564 A 3/1983 Kilbourne
4,412,717 A 11/1983 Monroe
4,456,322 A 6/1984 Ferroni
4,460,945 A * 7/1984 Chan ..... F21V 15/00 362/255
4,548,449 A 10/1985 Corsetti
4,572,601 A * 2/1986 Jones ..... H01R 33/46 439/180
4,610,496 A 9/1986 Schwartz et al.
4,632,480 A 12/1986 Carpenter
4,632,490 A 12/1986 Von Gunten
4,655,534 A 4/1987 Stursa
4,768,966 A 9/1988 Doherty
4,778,409 A 10/1988 Maddock
4,789,343 A * 12/1988 Dougherty ..... B60G 17/015 439/34
4,798,371 A 1/1989 Wallisser
4,825,393 A 4/1989 Nishiya
4,829,210 A * 5/1989 Benson ..... H01K 1/34 313/113
4,872,852 A 10/1989 Palitz, Jr.
4,881,157 A * 11/1989 Pahl ..... F21V 21/04 362/269
4,883,434 A 11/1989 Toyoshima
4,902,251 A 2/1990 Grzena
4,915,667 A 4/1990 Tobias-Pader
4,940,422 A 7/1990 Forish et al.
4,941,846 A 7/1990 Guimond et al.
4,975,813 A 12/1990 Chen
5,006,751 A 4/1991 Marshall
5,024,604 A 6/1991 Savin et al.
5,030,124 A 7/1991 Lorentzon
5,059,139 A 10/1991 Spinner
5,062,808 A 11/1991 Hosler, Sr.
5,072,339 A * 12/1991 Shimojo ..... B60Q 1/24 362/473
5,154,628 A 10/1992 Skegin
5,171,292 A 12/1992 Ortiz
5,195,906 A 3/1993 Szegda
5,278,741 A 1/1994 Ehrman
5,282,756 A 2/1994 Heindl et al.
5,302,778 A * 4/1994 Maurinus ..... H01L 25/167 174/521
5,316,494 A 5/1994 Flanagan et al.
D347,620 S 6/1994 Henrici
5,353,474 A * 10/1994 Good ..... B25F 5/006 16/421
5,362,246 A 11/1994 Lau
5,380,214 A 1/1995 Ortega, Jr.
5,382,181 A 1/1995 Ortiz
5,404,869 A * 4/1995 Parkyn, Jr. ..... G02B 19/0028 126/698
5,429,147 A * 7/1995 Barrington ..... A45B 15/00 135/33.41
5,436,816 A * 7/1995 Nagano ..... F21S 8/033 248/71
5,447,442 A 9/1995 Swart
5,456,611 A 10/1995 Henry et al.
5,471,375 A 11/1995 Lau
5,482,477 A 1/1996 Michael
5,485,356 A * 1/1996 Nguyen ..... H01R 13/717 174/66
5,502,481 A * 3/1996 Dentinger ..... G02B 27/0093 348/51
5,521,460 A 5/1996 Zhu
5,521,806 A * 5/1996 Hutzel ..... B60Q 3/06 340/473
5,526,190 A * 6/1996 Hubble, III ..... F21V 7/0091 347/102
5,547,400 A 8/1996 Wright
5,561,269 A 10/1996 Robertson et al.
5,573,419 A 11/1996 Chen
5,580,163 A * 12/1996 Johnson, II ..... F21V 14/02 362/239
5,593,324 A 1/1997 Ito
5,595,493 A 1/1997 Chen
5,595,499 A 1/1997 Zander et al.
5,595,513 A 1/1997 Kondo
5,597,233 A 1/1997 Lau

(56) References Cited

U.S. PATENT DOCUMENTS 5,613,769 A * 3/1997 Parkyn, Jr. ..... F21V 7/0091 126/698
5,622,423 A * 4/1997 Lee ..... F21L 4/02 362/102
5,632,643 A 5/1997 Shepherd et al.
5,634,812 A 6/1997 Chen
5,651,612 A * 7/1997 Braun ..... F21S 8/08 362/376
5,670,745 A * 9/1997 Yajima ..... G01S 19/36 174/50.5
5,673,996 A * 10/1997 Ducker ..... B43K 29/10 362/118
5,676,453 A * 10/1997 Parkyn, Jr. ..... G02B 19/0028 362/260
5,678,918 A * 10/1997 Lin ..... F21S 6/002 362/101
5,681,186 A 10/1997 Wright
5,695,357 A 12/1997 Wright
5,700,154 A 12/1997 Geary
5,703,719 A * 12/1997 Chen ..... F21S 9/037 359/515
5,707,246 A 1/1998 Perkins
5,741,159 A 4/1998 Wright
5,743,632 A * 4/1998 Carl ..... F21S 48/335 362/268
5,743,758 A 4/1998 Cheng et al.
5,746,606 A 5/1998 Sobhani
5,749,648 A 5/1998 Lin
5,800,212 A 9/1998 Hsu
5,828,765 A * 10/1998 Gable ..... H04R 1/028 181/150
5,842,872 A 12/1998 Hosler, Sr. et al.
5,890,794 A * 4/1999 Abtahi ..... B60Q 7/00 362/183
5,897,391 A 4/1999 Takahashi et al.
5,940,549 A * 8/1999 Wilde ..... G02B 6/126 385/15
5,941,632 A * 8/1999 Wedell ..... F21S 8/086 362/255
5,947,581 A * 9/1999 Schrimmer ..... A63H 27/10 362/189
5,989,070 A * 11/1999 Al-Turki ..... F21V 19/006 439/638
6,000,814 A * 12/1999 Nestell ..... F21S 48/1208 362/267
6,033,248 A 3/2000 Lyons
6,036,540 A 3/2000 Beloritsky
6,037,721 A * 3/2000 Lansing ..... F21V 23/0435 315/149
6,083,021 A 7/2000 Lau
6,120,164 A * 9/2000 Libin ..... F21V 21/30 362/227
6,123,429 A * 9/2000 Osawa ..... F21S 48/1388 313/113
6,132,059 A * 10/2000 Leibowitz ..... A45C 15/06 362/154
6,163,264 A 12/2000 Birch et al.
6,190,025 B1 * 2/2001 Solinsky ..... F21V 23/04 200/43.11
6,200,134 B1 * 3/2001 Kovac ..... A61C 19/004 362/800
6,224,410 B1 5/2001 Chen
6,241,261 B1 6/2001 Rehm
6,261,018 B1 * 7/2001 Chen ..... B43K 29/10 362/118
6,267,612 B1 7/2001 Arcykiewicz et al.
6,294,800 B1 * 9/2001 Duggal ..... C09K 11/7734 257/100
6,295,749 B1 * 10/2001 Lin ..... G09F 19/08 40/406
6,322,380 B1 11/2001 Conroy
6,380,683 B1 4/2002 Kahn
6,393,684 B2 5/2002 Masuda et al.
6,398,592 B1 6/2002 Mori et al.
6,406,333 B2 6/2002 Harris
6,491,534 B1 * 12/2002 Bonard ..... H01R 33/962 439/188
6,619,876 B2 9/2003 Vaitkus et al.
6,652,305 B1 11/2003 DiFusco
6,676,445 B2 1/2004 Hall et al.
6,679,647 B2 1/2004 Hixon
6,682,303 B2 1/2004 Wu
6,692,285 B2 2/2004 Islam
6,692,286 B1 2/2004 De Cet
6,695,636 B2 2/2004 Hall et al.
6,705,886 B1 3/2004 Brown
6,713,948 B2 3/2004 Meinecke
6,739,220 B1 * 5/2004 Johnson ..... B25B 9/00 81/53.1
6,743,041 B2 6/2004 Hozer et al.
6,761,469 B2 7/2004 Wu
6,769,926 B1 8/2004 Montena
6,783,383 B1 8/2004 Gibboney
6,799,869 B1 10/2004 Beadle
6,811,424 B2 11/2004 Seminara et al.
6,848,931 B2 2/2005 McMullen et al.
6,857,892 B2 2/2005 McLauchlan et al.
6,860,761 B2 3/2005 Lee et al.
6,921,279 B2 7/2005 Sian et al.
6,932,620 B2 8/2005 Ishiguro et al.
6,945,801 B2 9/2005 Brown
6,948,833 B2 9/2005 Wu
6,964,579 B2 11/2005 Seminara et al.
7,055,864 B2 6/2006 Pelfrey et al.
7,101,229 B2 9/2006 Tufano et al.
7,105,744 B1 9/2006 Kwong et al.
7,121,891 B2 10/2006 Cherian
7,150,648 B1 12/2006 Hall et al.
7,160,149 B1 1/2007 Chawgo
7,163,333 B2 1/2007 Lin
7,165,982 B2 1/2007 Hafele et al.
7,175,466 B2 2/2007 Feinweber et al.
7,189,113 B2 3/2007 Sattele et al.
7,226,202 B2 6/2007 Chen
7,229,303 B2 6/2007 Vermoesen et al.
7,234,973 B1 6/2007 Shelly
7,238,047 B2 7/2007 Saettele et al.
7,244,148 B2 7/2007 Maguire et al.
7,264,496 B2 9/2007 Wu
7,288,002 B2 10/2007 Rodrigues et al.
7,294,006 B1 11/2007 Chen
7,309,255 B2 12/2007 Rodrigues
7,347,726 B2 3/2008 Wlos
7,347,727 B2 3/2008 Wlos et al.
7,364,450 B2 4/2008 Hafner et al.
7,387,409 B1 6/2008 Beadle
7,387,522 B2 6/2008 Janos et al.
7,413,456 B1 8/2008 DiFusco
7,419,403 B1 9/2008 Paynter
7,455,550 B1 * 11/2008 Sykes ..... H01R 13/506 439/578
7,456,357 B1 11/2008 Kwong et al.
7,462,052 B2 12/2008 Karton
D586,299 S 2/2009 Suzuki et al.
7,484,988 B2 2/2009 Ma et al.
7,494,262 B2 2/2009 Runions et al.
7,513,795 B1 4/2009 Shaw
7,513,802 B2 4/2009 Tufano, Sr. et al.
7,530,850 B2 5/2009 Maguire et al.
7,549,786 B2 6/2009 Higley et al.
7,566,243 B1 7/2009 Hung
7,568,934 B1 8/2009 Williams et al.
7,575,459 B2 8/2009 Nickol
D601,967 S 10/2009 Shaw
D801,966 10/2009 Shaw
7,597,588 B1 10/2009 Hyzin et al.
7,618,288 B1 * 11/2009 DiFusco ..... H01R 33/22 439/253
D607,826 S 1/2010 Shaw
D607,827 S 1/2010 Shaw
D607,828 S 1/2010 Shaw
D607,829 S 1/2010 Shaw
D607,830 S 1/2010 Shaw
D608,294 S 1/2010 Shaw

(56) References Cited

U.S. PATENT DOCUMENTS

| | | | | |
|---|---|---|---|---|
| 7,695,292 | B2 | 4/2010 | Lee | |
| 7,727,011 | B2 | 6/2010 | Montena et al. | |
| 7,758,370 | B1 | 7/2010 | Flaherty | |
| 7,762,856 | B2 | 7/2010 | Friesen et al. | |
| 7,786,379 | B1 | 8/2010 | Kwong et al. | |
| 7,798,838 | B2 | 9/2010 | Grieff et al. | |
| 7,806,714 | B2 | 10/2010 | Williams et al. | |
| 7,841,896 | B2 | 11/2010 | Shaw et al. | |
| 7,850,472 | B2 | 12/2010 | Friedrich et al. | |
| 7,854,621 | B2 | 12/2010 | Poulsen | |
| 7,867,018 | B2 | 1/2011 | Krieg et al. | |
| 7,892,004 | B2 * | 2/2011 | Hertzler | H01R 13/5219 439/312 |
| 7,905,738 | B2 | 3/2011 | Donetsky | |
| 7,914,347 | B2 | 3/2011 | Paulus | |
| 7,938,570 | B2 | 5/2011 | Lee et al. | |
| 7,938,654 | B2 | 5/2011 | Stein | |
| 7,959,419 | B2 | 6/2011 | Borowski et al. | |
| 7,972,158 | B2 | 7/2011 | Wild et al. | |
| 7,972,173 | B1 | 7/2011 | Hyzin et al. | |
| 8,033,858 | B1 | 10/2011 | Chen | |
| 8,070,502 | B2 | 12/2011 | Mitter et al. | |
| 8,105,119 | B2 | 1/2012 | Swart et al. | |
| 8,146,225 | B2 | 4/2012 | Olinger et al. | |
| 8,167,637 | B1 | 5/2012 | Projkovski | |
| 8,187,015 | B2 | 5/2012 | Boyd et al. | |
| 8,206,175 | B2 | 6/2012 | Boyd et al. | |
| 8,221,161 | B2 | 7/2012 | Leibfried, Jr. | |
| 8,235,741 | B2 | 8/2012 | Schulze et al. | |
| 8,241,060 | B2 | 8/2012 | Sykes | |
| 8,608,802 | B2 * | 12/2013 | Bagga | A61B 17/68 606/62 |
| 8,668,504 | B2 | 3/2014 | Cofini | |
| 2001/0024367 | A1 * | 9/2001 | Shiau | F21L 7/00 362/188 |
| 2001/0033488 | A1 * | 10/2001 | Chliwnyj | F21S 10/04 362/231 |
| 2003/0104718 | A1 | 6/2003 | Holzer et al. | |
| 2007/0125202 | A1 * | 6/2007 | Johnson | H01K 3/32 81/53.11 |
| 2009/0075508 | A1 | 3/2009 | Mitter et al. | |
| 2011/0318954 | A1 | 12/2011 | Lin | |
| 2013/0012040 | A1 * | 1/2013 | Cofini | H01R 33/0836 439/108 |

* cited by examiner

LIGHT BULB RECEPTACLES AND LIGHT BULB SOCKETS

RELATED PATENT DATA

This application claims priority to U.S. Provisional Patent Application Ser. No. 62/015,919, entitled "Light Bulb Receptacles and Light Bulb Sockets," which was filed Jun. 23, 2014, and the teachings of which are incorporated herein by reference.

TECHNICAL FIELD

This disclosure relates to light bulb receptacles and light bulb sockets.

BACKGROUND OF THE DISCLOSURE

Electric light bulbs are ubiquitous for countless uses and applications. Electric light bulbs typically have a fixed life and require replacement. Some conventional light bulbs have a threaded base, and accordingly, these light bulbs may be screwed into a corresponding light fixture having a threaded receiver.

At least some aspects of the disclosure are directed towards apparatus and methods for facilitating insertion or removal of light bulbs with respect to light bulb receptacles.

BRIEF DESCRIPTION OF THE DRAWINGS

Example embodiments of the disclosure are described below with reference to the following accompanying drawings.

DETAILED DESCRIPTION OF THE DISCLOSURE

This disclosure is submitted in furtherance of the constitutional purposes of the U.S. Patent Laws "to promote the progress of science and useful arts" (Article 1, Section 8).

Figure 1:
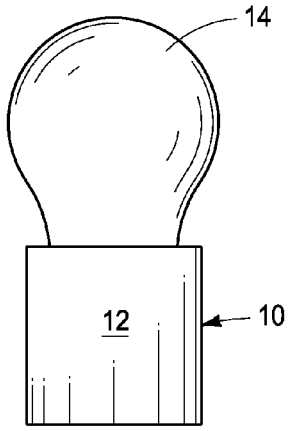
FIG. 1 is an illustrative view of one embodiment of a light bulb receptacle and light bulb according to one embodiment.
Figure 2:
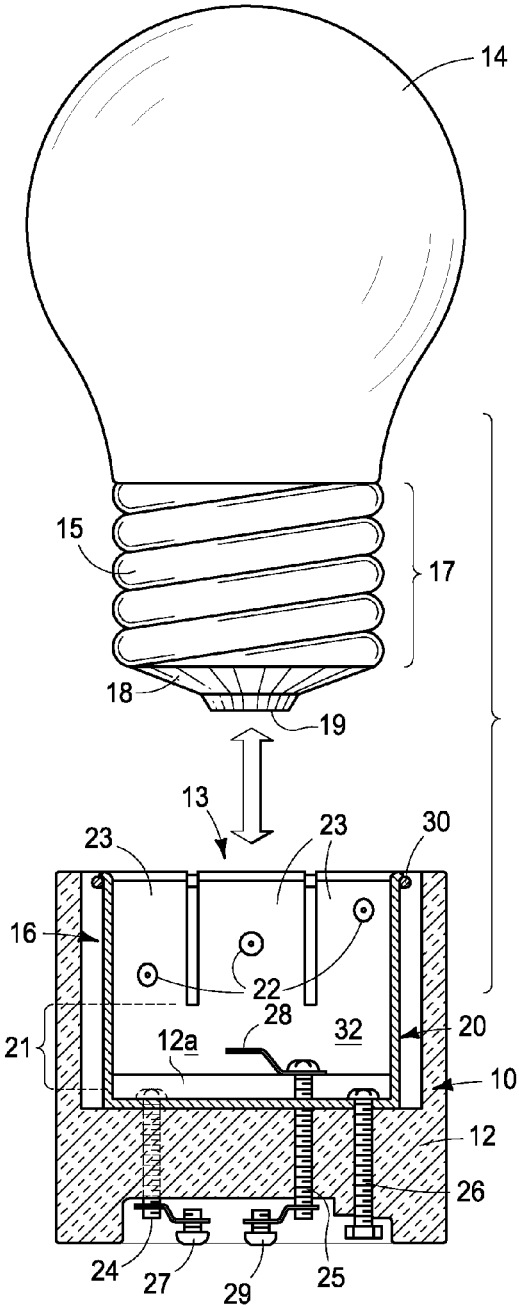
FIG. 2 is an exploded illustrative view of a light bulb and light bulb receptacle according to one embodiment.

FIG. 1 illustrates a light bulb receptacle 10 coupled with a light bulb 14 according to one embodiment of the disclosure. As described further below, light bulb 14 may include a threaded base which is received within a housing 12 (and socket 20 as shown in FIG. 2) of light bulb receptacle 10 according to one embodiment. In one embodiment, light bulb 14 may be rotated with respect to housing 12 and socket 20 to insert or remove light bulb 14 with respect to light bulb receptacle 10. As described further below, light bulb 14 may also be inserted or removed from light bulb receptacle 10 without rotation (e.g., in a linear direction) in one embodiment.

Referring to FIG. 2, additional details of an example embodiment of light bulb receptacle 10 are shown. The housing 12 is electrically insulative and defines a housing chamber 16 in the illustrated embodiment. An entirety of housing 12 is a unitary single member of a monolithic electrically insulative material, such as plastic or ceramic, in example embodiments.

In one embodiment, a first end of housing 12 is substantially enclosed and defines housing chamber 16 which is configured to receive a light bulb socket 20 described further below. A second end of housing 12 defines an opening 13 with respect to housing chamber 16. In one embodiment, housing 12 includes an extended portion 12*a* which engages a slot within the light bulb socket 20 as described below (an embodiment of the socket 20 including a slot is shown FIGS. 3 and 4). In one embodiment, extended portion 12*a* elevates terminal connector 28 above first end of socket 20 to further isolate terminal connector 28 from socket 20.

Light bulb socket 20 is received within the housing chamber 16 of housing 20 according to one embodiment. Light bulb socket 20 may be electrically conductive in some embodiments and may be electrically connected with a terminal of light bulb 14. For example, light bulb socket 20 may be copper or other conductive metal in more specific examples. As described below, socket 20 is configured to engage threads 15 of a threaded base 17 of light bulb 14 received within socket 20 in one implementation and to retain the threaded base 17 of light bulb 14 within housing 12.

Light bulb socket 20 is cylindrical and includes a plurality of fingers 23 which extend upwardly from proximal ends adjacent to a solid circular ring portion 21 of socket 20 towards distal ends adjacent to opening 13 in one embodiment. Ring portion 21 and fingers 23 define a light bulb chamber 32 which receives threaded base 17 of light bulb 14 and an opening 33 to chamber 32 (see FIG. 4) through which the threaded base 17 may be inserted or removed. Light bulb socket 20 including ring portion 21 and fingers 23 is a single unitary member of a monolithic electrically conductive material (e.g., copper) in the illustrated embodiment.

Fingers 23 individually include one or more engagement members 22 which are spaced from one another at different circumferential locations of light bulb socket 20 in the example arrangement shown in FIG. 2. Engagement members 22 are configured to engage and retain a threaded base 17 of light bulb 14 within housing 12 of light bulb receptacle 10 in one embodiment. In particular, the engagement members 22 may engage threads 15 of threaded base 17 to retain the light bulb 14 within housing 12 in one embodiment described in further detail below.

Threaded base 17 may be one electrical terminal of an example light bulb 14. As mentioned above, light bulb socket 20 may be electrically conductive in one embodiment and the electrically conductive engagement members 22 and fingers 23 thereof may provide electrical connection between the light bulb receptacle 10 and the threads 15 of light bulb 14 upon insertion of light bulb 14 into light bulb socket 20. In one embodiment, threaded base 17 is a negative terminal of light bulb 14.

Light bulb receptacle 10 also includes a plurality of connection members 24, 25, 26 which secure the light bulb socket 20 to the housing 12. In one embodiment, connection members 24, 25, 26 are electrically conductive and may be implemented as metal bolts or screws.

A first end of connection member 24 is electrically coupled with light bulb socket 20 (similar to connection member 26) and a second end thereof is coupled with a negative lead connector 27. Accordingly, in one embodiment, socket 20, member 24 and connector 27 provide electrical connection with the negative terminal (i.e., threaded base) of the light bulb 14 inserted into socket 20.

A negative wire may be coupled with negative lead connector 27 and an electrical power source (the negative wire and electrical power source are not shown) in one embodiment.

A first end of connection member 25 is coupled with a terminal connector 28 which is configured to provide electrical connection with a positive terminal 19 of light bulb 14 upon insertion of threaded base 15 of light bulb 14 into light bulb socket 20. A second end of connection member 25 is coupled with a positive lead connector 29 which may be coupled with a positive wire and electrical power source (not shown).

Connection member 26 operates to secure light bulb socket 20 and housing 12 together and may also be utilized as a connection to the negative terminal of light bulb 15.

As described further below, one embodiment of light bulb receptacle 10 permits light bulbs 14 to be inserted into socket 20 and removed from socket 20 in a linear and/or rotational manner. For example, the engagement members 22 are positioned in locations which correspond to threads 15 of light bulb 14 and allow light bulb 14 to be rotated in opposing directions for insertion or removal of the light bulb 14 with respect to socket 20. In one more specific embodiment, the engagement members 22 are spaced at different distances from a common end of socket 20 to define a thread pattern which corresponds to a pattern of threads 15 of light bulb base 17.

If a light bulb 14 is moved linearly (i.e., without rotation) with respect to socket 20, the fingers 23 are individually configured to move outwardly within housing chamber 16 to permit individual threads 15 of base 17 to pass past the engagement members 22. In one embodiment, fingers 23 of light bulb socket 20 have spring properties to return to original inward positions following the insertion or removal of the base 17 of light bulb 14 with respect to light bulb chamber 32 which causes outward movement of the fingers 23. If the base 17 of a bulb 14 is inserted into chamber 32, the fingers 23 may return to the original inward positions where the engagement members 22 engage the threads 15 of base 17 to retain the threaded base 17 within chamber 32 and receptacle 10.

In one embodiment, a retaining member 30 such as a circular spring is provided around the fingers 23 at a location proximate to distal ends of the fingers 23 and the opening 33 to light bulb chamber 32. Retaining member 30 is a spring steel ring in one example embodiment. Retaining member 30 impedes or restricts but allows outward movement of the distal ends of fingers 23 as threads 15 of base 17 pass the engagement members 22 during insertion or removal of the light bulb 14. Retaining member 30 operates to provide a force to urge the distal ends of fingers 23 inwardly after the outward movement, for example, such that engagement members 22 of fingers 23 engage threads 15 of light bulb base 17 to retain light bulb 14 within the receptacle 10.

In one embodiment, retaining member 30 is not continuous about its entire circumference (e.g., an open slot may be provided in the retaining member 30) to permit the retaining member 30 to move outwardly and increase in diameter during passage of threads 15 by engagement members 22 during insertion or removal of light bulb 14 with respect to receptacle 10. The memory properties of the retaining member 30 cause the retaining member 30 to return to the original position having a smaller diameter following the passage of the threads 15 by the engagement members 22 during insertion or removal of the light bulb 14. The engagement members 22 engage the threads 15 and retain the light bulb base 17 within the receptacle 10 following the insertion of the light bulb base 17 into the socket 20.

Figure 3:
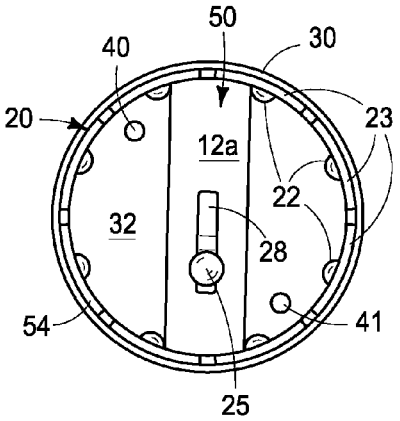
FIG. 3 is a top view of a light bulb socket according to one embodiment.
Figure 4:
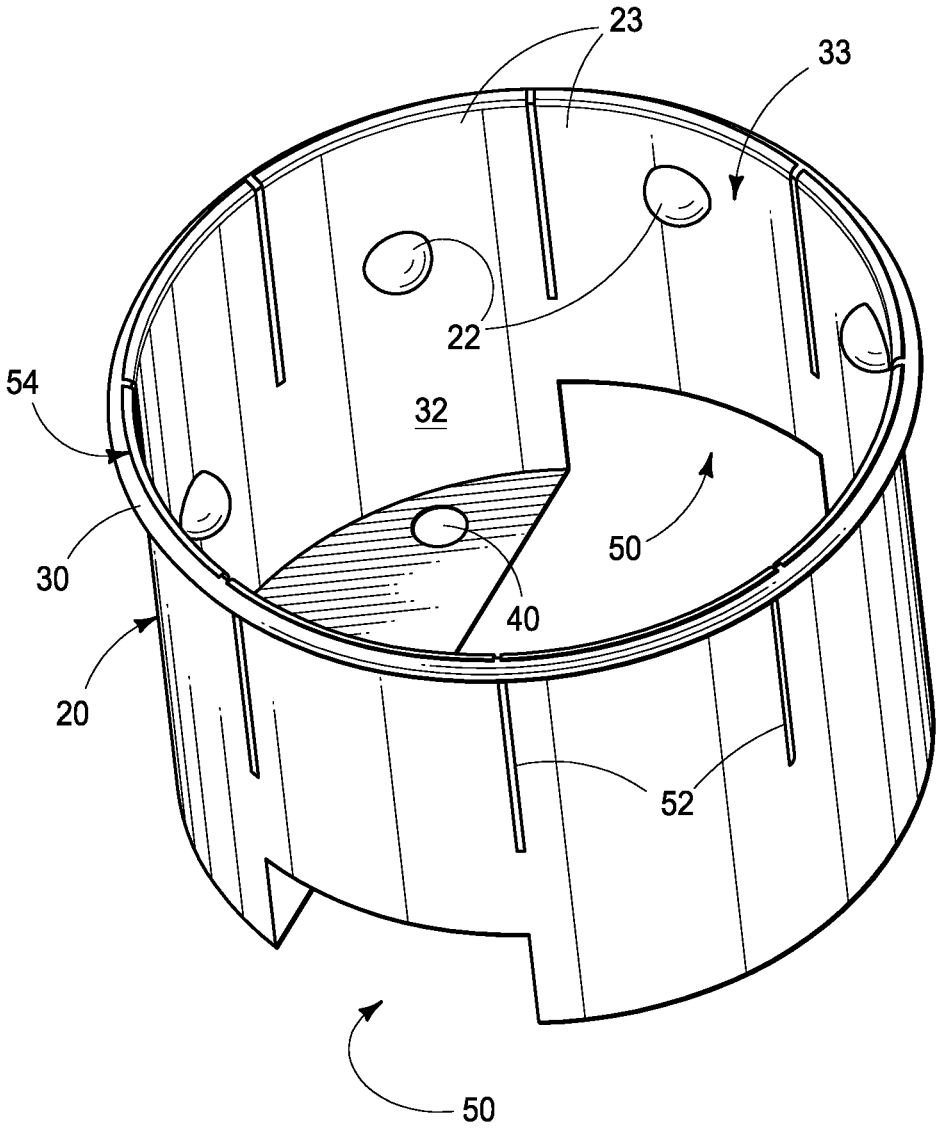
FIG. 4 is an isometric view of a light bulb socket according to one embodiment.

Referring to FIGS. 3 and 4, additional details regarding light bulb socket 20 are shown in one embodiment. The engagement members 22 are spaced about the circumference of light bulb chamber 32 to engage and retain a threaded base 17 of a light bulb 14 within chamber 32. Light bulb socket 20 includes a slot 50 which receives extended upper portion 12*a* of housing 12. The connection member 25 and terminal connector 28 are received within slot 50 during coupling of the light bulb socket 20 to the housing 12 and are spaced from socket 20 providing electrical isolation of the connection member 25 and terminal connector 28 from the light bulb socket 20. Retaining member 30 is provided about the distal ends of fingers 23 to urge engagement members 22 inwardly to engage the threads 15 of threaded base 17 received within chamber 32.

In one specific example embodiment, light bulb socket 20 has a diameter of 1.08" and a height of 0.77". The engagement members 22 are 0.10" dimples formed in the fingers 23 and located at 45 degree increments about the chamber 32 and which are spaced at different distances from the distal ends of fingers 23. In one embodiment, the engagement members 22 are individually spaced upwards or downwards from the distal ends of fingers 23 by 0.05" with respect to adjacent engagement members 22 in a right hand twist in the presently described example. A plurality of slots 52 each having a length of 0.41" are provided at 45 degree increments about the chamber 32 and define the respective fingers 23 in one configuration.

The distal ends of fingers 23 of the illustrated embodiment have a lip 54 having a 0.05" quarter diameter radius and the lips 54 of the fingers 23 receive and engage retaining member 30. Retaining member 30 has a thickness (diameter) of 0.02" and a radius of 0.56" in the example embodiment. The lip 54 aids with maintaining positioning of the retaining member 30 at the second end of the socket 20 (at the distal ends of fingers 23) to urge the distal ends of fingers 23 inwardly such that the engagement members 22 engage the threads 15 of the threaded base 17 within socket 20. Plural apertures 40, 41 are shown in the depicted embodiment of the socket 20 of FIG. 3 to receive connection members 24, 26.

Figure 5:
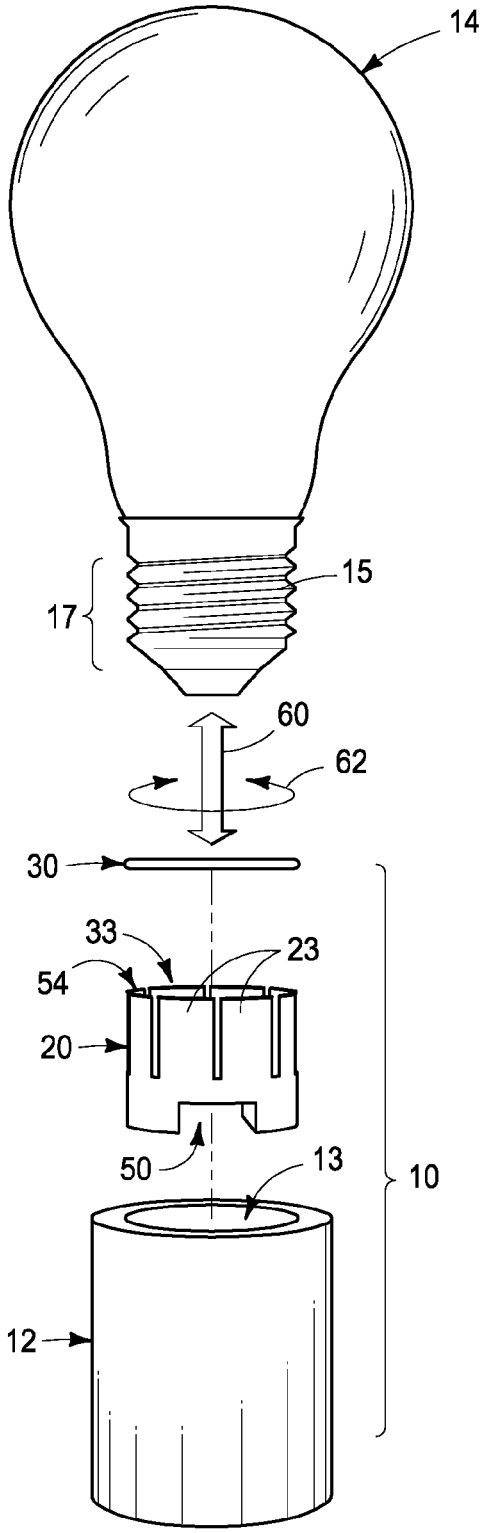
FIG. 5 is an exploded illustrative view of a light bulb and components of a light bulb receptacle according to one embodiment.

Referring to FIG. 5, light fixture 10 and bulb 14 are shown in an exploded view. For assembly, light socket 20 is inserted into opening 13 and is connected with housing 12 using connection members 24, 26 discussed above. Retaining member 30 is positioned about the distal ends of fingers 23 adjacent to lip 54 to cause engagement members 22 to engage the threads 15 of light bulb 14 inserted into chamber 32. The light bulb 14 may be moved in linear directions 60 with respect to receptacle 10 or rotational directions 62 for insertion/removal of light bulb 14 with respect to receptacle 10.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended aspects appropriately interpreted in accordance with the doctrine of equivalents.

Further, aspects herein have been presented for guidance in construction and/or operation of illustrative embodiments of the disclosure. Applicant(s) hereof consider these described illustrative embodiments to also include, disclose and describe further inventive aspects in addition to those explicitly disclosed. For example, the additional inventive aspects may include less, more and/or alternative features than those described in the illustrative embodiments. In more specific examples, Applicants consider the disclosure to include, disclose and describe methods which include less, more and/or alternative steps than those methods explicitly disclosed as well as apparatus which includes less, more and/or alternative structure than the explicitly disclosed structure.

What is claimed is:

1. A light bulb receptacle comprising:

a housing which defines a housing chamber;

a light bulb socket within the housing chamber and which comprises a first end and a second end about a light bulb chamber which is configured to receive a base of a light bulb;

wherein the light bulb socket further comprises a plurality of fingers which extend outwardly from the first end toward the second end and define an opening to the light bulb chamber at the second end;

wherein the fingers are individually configured to move outwardly from the light bulb chamber during insertion and removal of the base of the light bulb with respect to the light bulb chamber via the opening; and wherein the fingers individually comprise an engagement member configured to engage the base of the light bulb received within the light bulb chamber and to retain the base of the light bulb within the light bulb chamber.

2. The receptacle of claim 1 wherein the engagement members are electrically conductive and configured to electrically couple with the base of the light bulb received within the light bulb chamber and which comprises a terminal of the light bulb.

3. The receptacle of claim 2 wherein the fingers are electrically conductive.

4. The receptacle of claim 2 wherein the light bulb socket and the fingers thereof are electrically conductive.

5. The receptacle of claim 4 wherein the housing is electrically insulative.

6. The receptacle of claim 1 further comprising a retaining member about the fingers of the light bulb socket proximate to the second end and the opening to the light bulb chamber.

7. The receptacle of claim 6 wherein the light bulb socket has a cylindrical shape, and the retaining member has a circular shape.

8. The receptacle of claim 7 wherein the retaining member is configured to impede outward movement of the fingers at the second end of the light bulb socket.

9. The receptacle of claim 6 wherein the fingers include a lip proximate to the second end of the light bulb socket to receive the retaining member.

10. The receptacle of claim 6 wherein the retaining member urges the fingers at the second end inwardly to provide engagement of the engagement members with threads of the base of the light bulb received within the light bulb chamber.

11. The receptacle of claim 1 wherein the light bulb socket comprises a circular ring portion proximate the first end, and the fingers extend from the circular ring portion towards the opening at the second end of the light bulb socket.

12. The receptacle of claim 1 wherein the light bulb socket and fingers comprise a single unitary member.

13. The receptacle of claim 1 wherein the light bulb socket comprises a slot proximate the first end to receive a terminal connector configured to be coupled with a terminal of the base of the light bulb received within the light bulb chamber.

14. The receptacle of claim 1 wherein the engagement members are spaced at different distances from distal ends of the fingers.

15. The receptacle of claim 14 wherein the engagement members are spaced at the different distances from the distal ends of the fingers corresponding to a twist of threads of the base of the light bulb received within the light bulb chamber.

16. The receptacle of claim 1 wherein the housing comprises a first end and a second end about the housing chamber, and wherein the housing is substantially enclosed at the first end of the housing and has an opening proximate to the second end of the housing to receive the light bulb socket.

17. The receptacle of claim 16 wherein the entirety of the housing is a single unitary member.

18. A light bulb receptacle comprising:

an electrically insulative housing which defines a housing chamber;

a light bulb socket within the housing chamber and which comprises a first end and a second end about a light bulb chamber which is configured to receive a base of a light bulb;

wherein the light bulb socket further comprises a plurality of fingers which extend outwardly from the first end toward the second end and define an opening to the light bulb chamber at the second end, and wherein distal ends of the fingers individually include a lip;

wherein the fingers are individually configured to move outwardly from the light bulb chamber during insertion and removal of the base of the light bulb with respect to the light bulb chamber via the opening;

wherein the fingers individually comprise an engagement member configured to engage the base of the light bulb received within the light bulb chamber;

wherein the light bulb socket, the fingers and the engagement members are each electrically conductive and configured to conduct electricity with respect to a terminal of the base of the light bulb received within the light bulb chamber; and a spring retaining member adjacent to the lips of the fingers of the light bulb socket proximate to the second end of the light bulb socket and configured to urge the distal ends of the fingers inwardly to provide engagement of the engagement members with threads of the base of the light bulb received within the light bulb chamber and to retain the base of the light bulb within the light bulb chamber.

19. A light bulb socket comprising:

a first end and a second end about a light bulb chamber which is configured to receive a base of a light bulb;

a circular ring portion proximate the first end;

a plurality of fingers which extend outwardly from the first end toward the second end and define an opening to the light bulb chamber at the second end;

wherein the fingers are individually configured to move outwardly from the light bulb chamber during insertion and removal of the base of the light bulb with respect to the light bulb chamber via the opening; and wherein the fingers individually comprise an engagement member configured to engage the base of the light bulb received within the light bulb chamber and to retain the base of the light bulb within the light bulb chamber.

20. The light bulb socket of claim 19 further comprising a spring retaining member proximate to the second end and configured to urge distal ends of the fingers inwardly towards the base of the light bulb received within the light bulb chamber.

* * * * *